US010340627B2

(12) United States Patent
Huynh

(10) Patent No.: US 10,340,627 B2
(45) Date of Patent: Jul. 2, 2019

(54) HIGH PRESSURE SEALED ELECTRICAL CONNECTOR

(71) Applicant: Eaton Intelligent Power Limited, Dublin, OH (US)

(72) Inventor: Tam Chi Huynh, Richfield, MN (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/307,718

(22) PCT Filed: Apr. 29, 2015

(86) PCT No.: PCT/US2015/028260
§ 371 (c)(1),
(2) Date: Oct. 28, 2016

(87) PCT Pub. No.: WO2015/168266
PCT Pub. Date: Nov. 5, 2015

(65) Prior Publication Data

US 2017/0054247 A1 Feb. 23, 2017

Related U.S. Application Data

(60) Provisional application No. 61/986,380, filed on Apr. 30, 2014.

(51) Int. Cl.
*H01R 13/52* (2006.01)
*F15B 13/043* (2006.01)
(Continued)

(52) U.S. Cl.
CPC ..... *H01R 13/521* (2013.01); *F15B 13/043* (2013.01); *H01R 13/5202* (2013.01);
(Continued)

(58) Field of Classification Search
CPC .... H01R 13/533; H01R 13/426; H01R 13/52; H01R 13/521; H01R 13/5202;
(Continued)

(56) References Cited

U.S. PATENT DOCUMENTS 3,450,160 A 6/1969 Tess
4,003,620 A 1/1977 O'Brien et al.
(Continued)

FOREIGN PATENT DOCUMENTS

EP 0 235 365 A2 9/1987

OTHER PUBLICATIONS

International Search Report and Written Opinion of the International Searching Authority for International Patent Application No. PCT/US2015/028260 dated Aug. 13, 2015, 9 pgs.
(Continued)

*Primary Examiner* — Edwin A. Leon
*Assistant Examiner* — Milagros Jeancharles
(74) *Attorney, Agent, or Firm* — Merchant & Gould P.C.

(57) ABSTRACT

An electrical connector includes a housing, a conductive pin, a first seal, and a sealant. The housing has a bore and first and second ends exposed at different pressures when in use. The bore extends between the first and second ends. The conductive pin is arranged within the bore and configured to engage a first wire at the first end and a second wire at the second end. The first seal is arranged around the conductive pin and engaged between the conductive pin and the bore to provide seal therebetween. The sealant is provided to fill the bore between the first end and the first seal. The sealant may be an epoxy-based sealant.

23 Claims, 6 Drawing Sheets

(51) Int. Cl.
*H01R 13/533* (2006.01)
*H01R 103/00* (2006.01)

(52) U.S. Cl.
CPC ..... *H01R 13/5216* (2013.01); *H01R 13/533* (2013.01); *H01R 2103/00* (2013.01)

(58) Field of Classification Search
CPC ..... H01R 24/38; H01R 4/38; H01R 2103/00; F16K 31/02; F17D 3/00; F15B 13/043
USPC ..... 439/276, 936, 587, 271; 174/74 R, 77 R, 174/84 R, 85, 91
See application file for complete search history.

(56) References Cited

U.S. PATENT DOCUMENTS 4,193,655 A * 3/1980 Herrmann, Jr. ..... H01R 13/502 439/166
4,454,381 A * 6/1984 Ito ..... H01B 17/30 174/151
4,596,177 A * 6/1986 Biafore ..... B64C 13/40 91/35
4,599,487 A * 7/1986 Blank ..... H02G 3/22 174/151
4,690,482 A * 9/1987 Chamberland ..... H01R 13/533 439/578
4,723,230 A * 2/1988 Chelminski ..... E21B 17/028 181/110
4,874,335 A 10/1989 Kussel et al.
5,611,680 A * 3/1997 Small ..... B67D 7/38 174/47
6,254,432 B1 * 7/2001 Yoshigi ..... H01R 13/5208 439/604
6,364,677 B1 4/2002 Nysveen et al.
7,417,189 B2 * 8/2008 Sawada ..... H01R 13/5208 174/650
7,772,506 B2 * 8/2010 Suter ..... G02B 6/4428 137/797
8,287,295 B2 * 10/2012 Sivik ..... H02G 3/22 439/271
8,316,877 B2 * 11/2012 Numazaki ..... F16K 31/0655 137/312
8,413,951 B2 * 4/2013 Nomichi ..... F16K 31/0679 137/468
8,496,225 B2 * 7/2013 Numazaki ..... F17C 13/04 137/551
9,303,661 B2 4/2016 Fagerlund et al.
9,404,603 B2 * 8/2016 Johnson ..... G01M 3/3236
2002/0108656 A1 * 8/2002 Miller ..... H01R 13/5202 137/560
2005/0186823 A1 8/2005 Ring et al.
2006/0148304 A1 * 7/2006 Kennedy ..... H01R 13/405 439/404
2007/0131444 A1 * 6/2007 Shadel ..... H01R 4/726 174/74 R
2008/0258090 A1 10/2008 Najmolhoda et al.
2009/0007976 A1 * 1/2009 Desbois-Renaudin ..... F15B 13/01 137/624.27
2012/0028489 A1 2/2012 Gramsamer et al.
2012/0279212 A1 11/2012 Fagerlund et al.

OTHER PUBLICATIONS

Extended European Search Report for corresponding European Patent Application No. 15785483.7 dated Sep. 25, 2017, 8 pages.

* cited by examiner

HIGH PRESSURE SEALED ELECTRICAL CONNECTOR

CROSS-REFERENCE TO RELATED APPLICATION(S)

This application is a U.S. National Stage of PCT/US2015/028260, filed on Apr. 29, 2015, which claims benefit of U.S. Patent Application Ser. No. 61/986,380 filed on Apr. 30, 2014, and which applications are incorporated herein by reference. To the extent appropriate, a claim of priority is made to each of the above disclosed applications.

BACKGROUND

Hydraulic control systems are used in many industrial and mobile applications, such as excavating equipment, hoists, lifting arms, and a number of similar devices. Such control systems typically include control valves in the form of a spool slidable within a bore, the position of the spool determining which of a pair of outlet ports is connected to relatively high pressure fluid and which is connected to a low pressure at any given time.

Often times, the hydraulic control systems contain electric devices arranged at different pressures. For example, some electric devices are arranged at atmospheric pressure, and other devices are arranged to be exposed to hydraulic fluid at a higher pressure than the atmospheric pressure. Typically, the electric devices arranged at different pressures are electrically connected through electrical connectors. Thus, such electrical connectors need to be reliably secured within the hydraulic control system and environmentally sealed between the different pressures.

SUMMARY

In general terms, this disclosure is directed to a sealed electrical connector subject to different pressures at its connecting ends. In one possible configuration and by non-limiting example, the electrical connector is sealed with a sealing member and a sealant. Various aspects are described in this disclosure, which include, but are not limited to, the following aspects.

One aspect is an electrical connector having a housing, a conductive pin, a first seal, and a sealant. The housing has a bore and first and second ends. When the electrical connector is in use, the first end is arranged at a first pressure, and the second end is arranged at a second pressure different from the first pressure. The bore extends between the first and second ends. The conductive pin is arranged within the bore and configured to engage a first wire at the first end and a second wire at the second end. The first seal is arranged around the conductive pin and engaged between the conductive pin and the bore to provide seal therebetween. The sealant is provided to fill the bore between the first end and the first seal. In some examples, the first pressure is greater than the second pressure. The sealant may be an epoxy-based sealant.

The electrical connector may further include a second seal arranged around the conductive pin adjacent the first seal. The first seal is positioned between the second seal and the sealant, and the second seal is not exposed to the sealant.

The conductive pin may be configured as one piece. In other examples, the conductive pin includes a first sub-pin and a second sub-pin. The first sub-pin is arranged within the bore and has a first wire end and a first coupling end. The first wire end engages the first wire at the first end. The second sub-pin is arranged within the bore and has a second wire end and a second coupling end. The second wire end engages the second wire at the second end, and the second coupling end engages the first coupling end of the first sub-pin.

Another aspect is a system including a system housing, a first electrical device, a second electrical device, and an electrical connector. When the system is in use, the first electrical device is arranged at a first pressure, and the second electrical device is arranged at a second pressure. The first pressure may be greater than the second pressure. The electrical connector is engaged within the system housing and configured to electrically connect the first electrical device to the second electrical device. The connector may include a connector housing, an outer seal, a first wire, a second wire, a conductive pin, a first inner seal, and a sealant. The connector housing has a bore and first and second ends. When the connector is in use, the first end is arranged at the first pressure, and the second end is arranged at the second pressure. The bore extends between the first and second ends. The outer seal is arranged around the connector housing and configured to provide seal between the connector housing and the system housing. The first wire is electrically connected to the first electrical device. The second wire is electrically connected to the second electrical device. The conductive pin is arranged within the bore and configured to engage the first wire at the first end and the second wire at the second end. The first inner seal is arranged around the conductive pin and engaged between the conductive pin and the bore to provide seal therebetween. The sealant fills the bore between the first end and the first inner seal.

Yet another aspect is a pilot valve system including a body, a solenoid assembly, a control unit, a spool assembly, and an electrical connector. The body has a fluid inlet and a fluid outlet. The solenoid assembly is operated at a first pressure. The control unit is operated at a second pressure lower than the first pressure. The spool assembly is engaged with the solenoid assembly and operated to control fluid flow between the fluid inlet and the fluid outlet. The electrical connector is engaged within the body and configured to electrically connect the control unit to the solenoid assembly. The connector includes a connector housing, an outer seal, a first wire, a second wire, a conductive pin, a first inner seal, and a sealant. The connector housing has a bore and first and second ends. When the connector is in use, the first end is arranged at the first pressure, and the second end is arranged at the second pressure. The bore extends between the first and second ends. The outer seal is arranged around the connector housing and configured to provide seal between the connector housing and the system housing. The first wire is electrically connected to the solenoid assembly, and the second wire is electrically connected to the control unit. The conductive pin is arranged within the bore and configured to engage the first wire at the first end and the second wire at the second end. The first inner seal is arranged around the conductive pin and engaged between the conductive pin and the bore to provide seal therebetween. The sealant fills the bore between the first end and the first inner seal.

DETAILED DESCRIPTION

Figure 1:
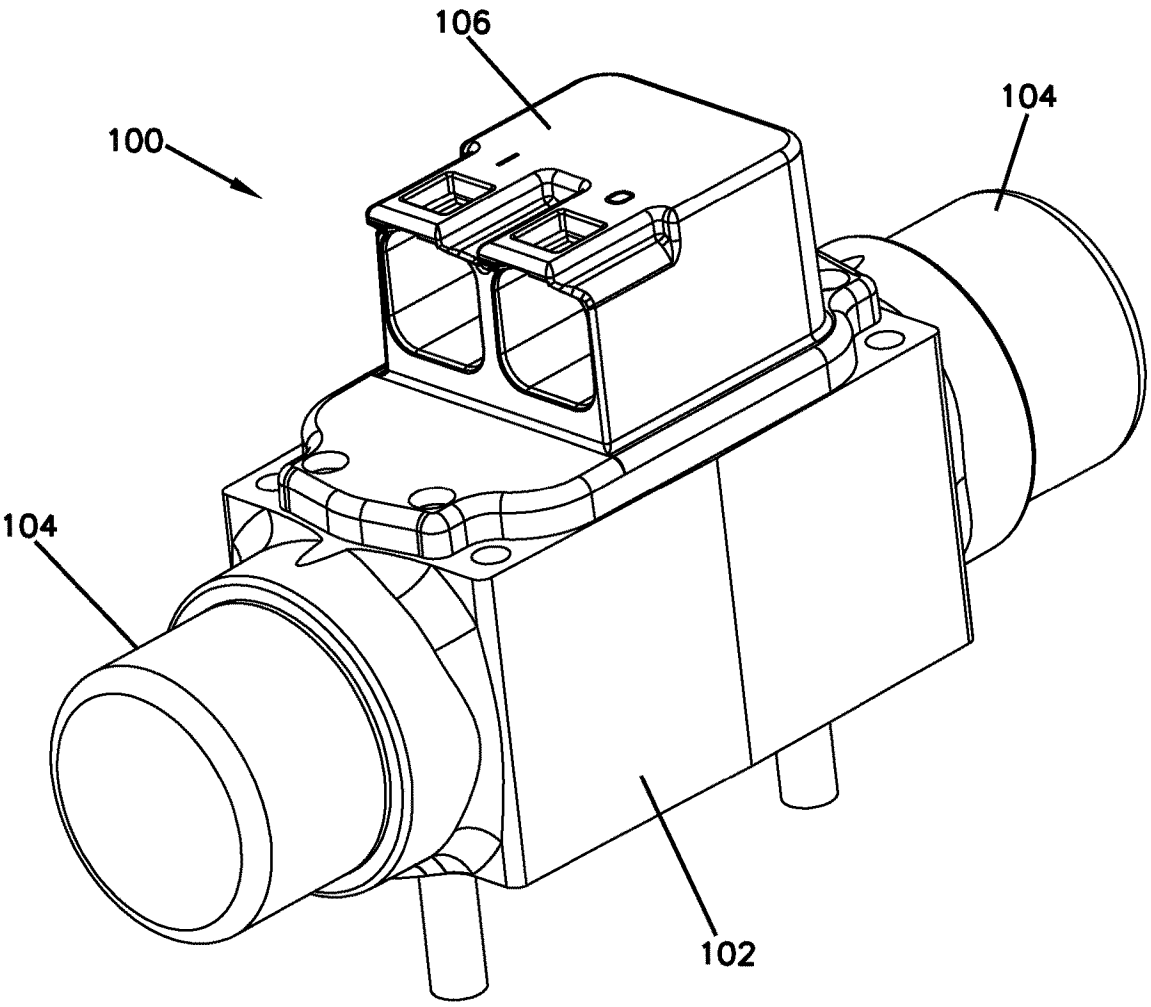
FIG. 1 is a perspective view of an exemplary pilot valve system.

FIG. 1 is a perspective view of an exemplary pilot valve system 100. The pilot valve system 100 operates to control a high-pressure and/or high-volume flow by controlling a limited-flow control feed to a separate piloted valve. In some examples, the pilot valve system 100 is used in a twin spool control valve arrangement, which operates to control hydraulic equipment of different types. Examples of such a twin spool control valve arrangement are described in U.S. patent application Ser. No. 13/386,281, titled CONTROL ARRANGEMENT, filed on Jul. 20, 2009, and U.S. patent application Ser. No. 13/386,235, titled CONTROL ARRANGEMENT, filed on Jul. 20, 2009. The disclosures of these patent applications are hereby incorporated by reference in their entireties. In some examples, the system 100 includes a body 102, an actuator 104, and a control unit 106. The system 100 is described in further detail with reference to FIG. 2.

Figure 2:
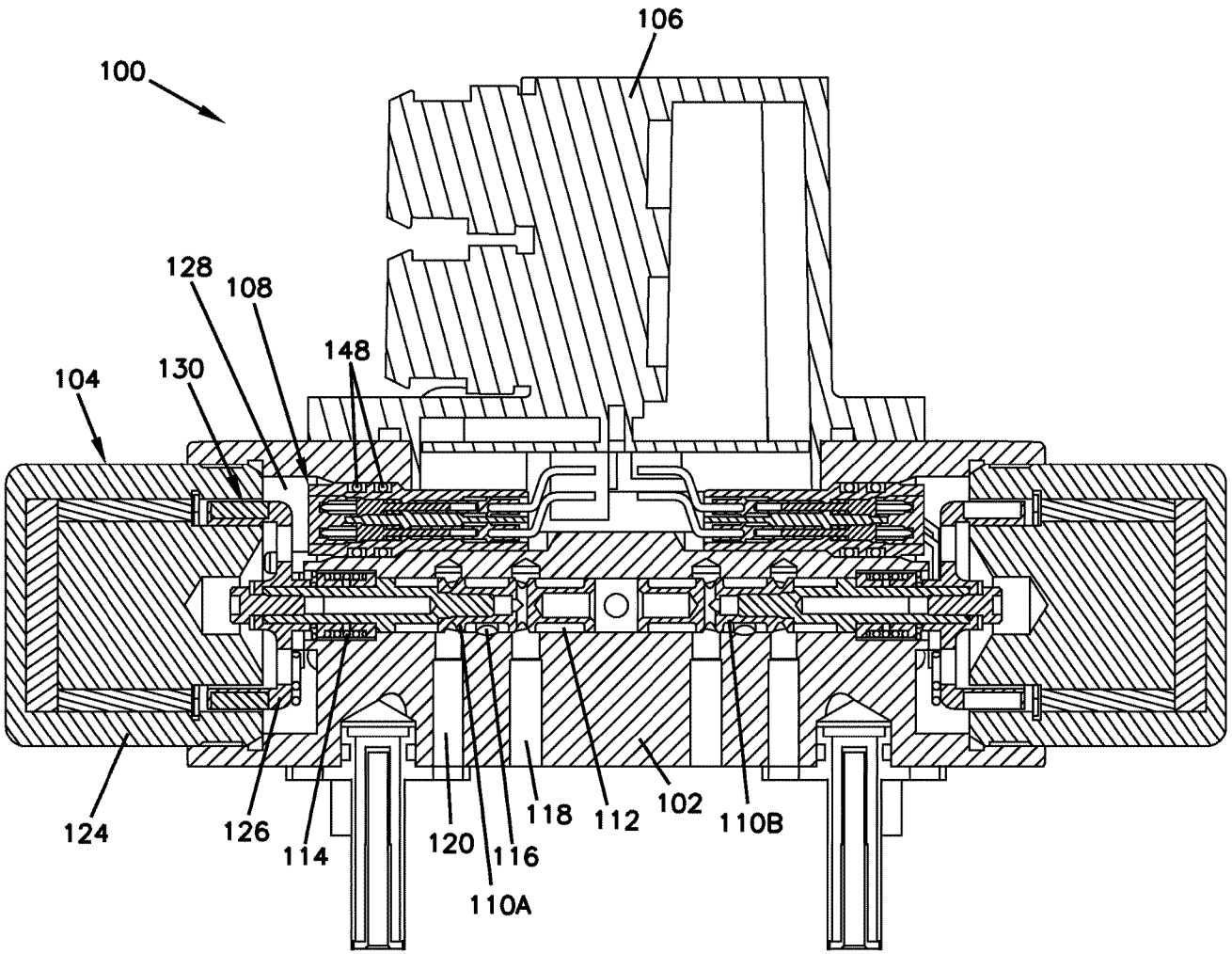
FIG. 2 is a cross-sectional view of the pilot valve system of FIG. 1.

FIG. 2 is a cross-sectional view of the pilot valve system 100 of FIG. 1. As discussed above, the pilot valve system 100 includes the body 102, the actuator 104, and the control unit 106. The pilot valve system 100 further includes an electrical connector 108 configured to electrically connect the actuator 104 and the control unit 106.

The body 102 contains a first pilot spool assembly 110A and a second pilot spool assembly 110B, which are collectively referred to as pilot spool assemblies 110 in either the singular or plural form as required by context. In the depicted example, the first and second spool assemblies 110A and 110B are controlled in a similar manner. Further, other components of the body 102 are configured symmetrically for the first and second spool assemblies 110A and 110B, and, therefore, described primarily for either the first or second spool assembly 110A or 110B. The pilot spool assembly 110 is configured to be moved by the actuator 104 along a spool chamber 112. In some examples, the pilot spool assembly 110 includes a spring mechanism 114 for holding the assembly 110 in a neutral position when not actuated by the actuator 104.

The body 102 further includes a pilot inlet 116, a first pilot outlet 118, and a second pilot outlet 120. As described below, depending on the position of the pilot spool assembly 110 within the spool chamber 112, the pilot inlet 116 is in fluid communication with either the first pilot outlet 118 or the second pilot outlet 120. As such, a pilot fluid selectively flows from the pilot inlet 116 either to the first pilot outlet 118 or to the second pilot outlet 120.

The actuator 104 operates to control the position of the pilot spool assembly 110 along the spool chamber 112. In the depicted example, the actuator 104 is an electromagnetic actuator, which includes a magnet assembly 124 and a voice coil assembly 126. In this document, the actuator 104 is also referred to as a solenoid assembly. The magnet assembly 124 is fixed to the body 102, which defines an actuator chamber 128 within which the voice coil assembly 126 moves. The voice coil assembly 126 is coupled to the pilot spool assembly 110 and moves relative to the magnet assembly 124 within the actuator chamber 128 by electromagnetic force. For example, the voice coil assembly 126 includes a winding 130 to which an electric current is applied to generate a magnetic field therearound. The interaction between the magnetic field around the voice coil assembly 126 and the magnetic field of the associated magnet assembly 124 is used to drive the pilot spool assembly 110 for movement to desired positions.

In some examples, the actuator chamber 126 provides a space through which a pressure different from atmospheric pressure is applied. For example, the pilot valve system 100 is configured to circulate a return fluid through the body 102, and the actuator chamber 126 is configured to be exposed to the return fluid flowing to a tank. In some examples, the return fluid is pressurized to a higher pressure than atmospheric pressure before returning to the tank. Thus, the actuator chamber 126 is subject to a higher pressure than the atmospheric pressure.

The control unit 106 is operable to control the current applied to the winding 130 of the voice coil assembly 126 and thus to control the position of the pilot spool assembly 110 within the spool chamber 112. In the depicted example, the control unit 106 is arranged on the body 102 and configured to be connected to other electrical devices or power supply. In some examples, the control unit 106 is open to the atmospheric surrounding, thereby being exposed at atmospheric pressure.

The electrical connector 108 is configured to connect the control unit 106 to the actuator 104. As described above, the actuator 104 and the control unit 106 are exposed to different pressures, and, thus, the electrical connector 108 is subject to different pressures at the connecting ends of the connector 108. The electrical connector 108 is described in further detail with reference to FIGS. 3-6.

Figure 3:
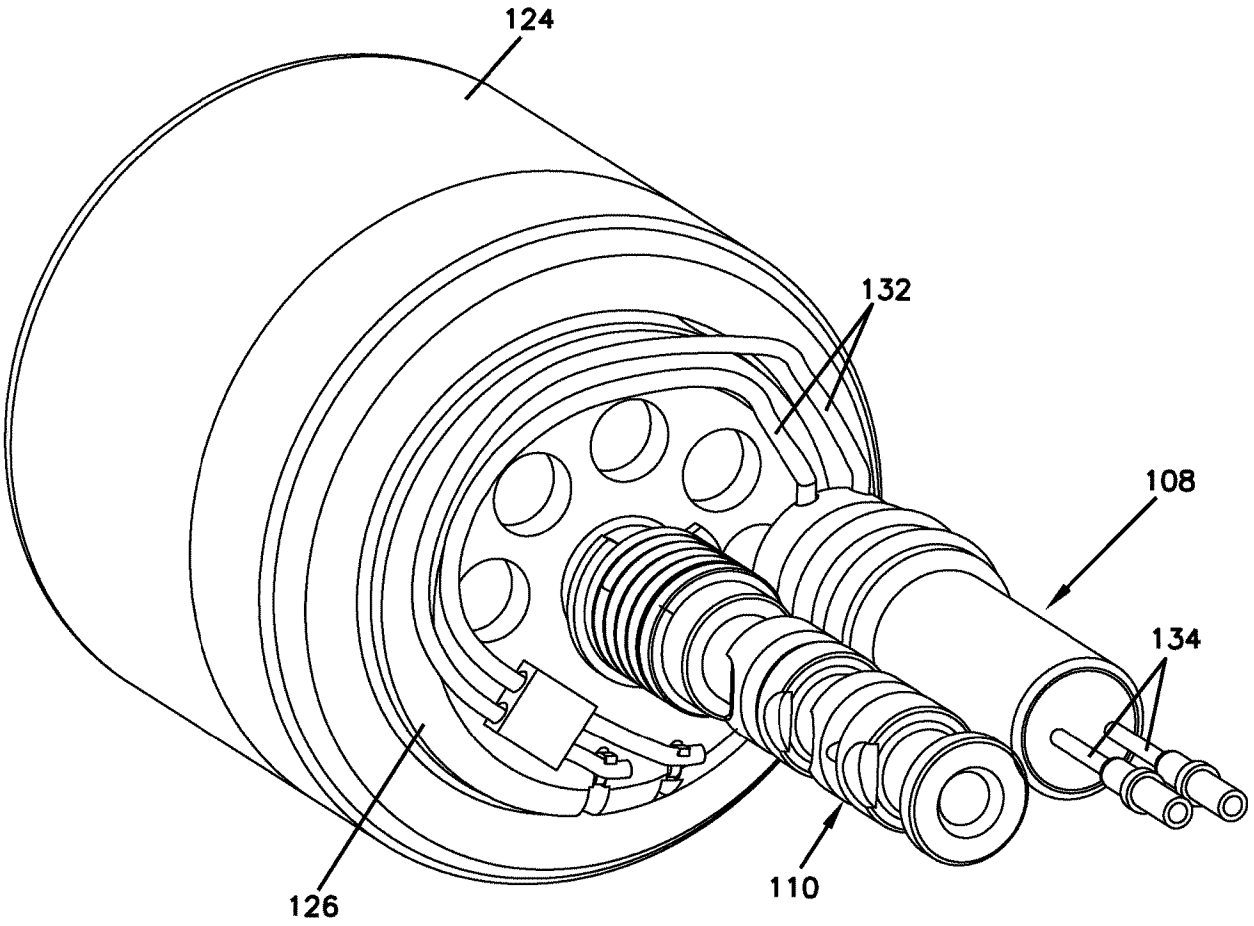
FIG. 3 illustrates an exemplary electrical connector used in the pilot valve system.

FIG. 3 illustrates an exemplary electrical connector 108 used in the pilot valve system 100. In the depicted examples, the electrical connector 108 is connected to the voice coil assembly 126. The electrical connector 108 includes a first pair of wires 132 and a second pair of wires 134. The first pair of wires 132 electrically connects the connector 108 to the winding 130 of the voice coil assembly 126. The second pair of wires 134 electrically connects the connector 108 to the control unit 106. As such, the electrical connector 108 provides an electrical connection between the actuator 104 and the control unit 106. However, it is apparent that the electrical connector 108 can be used to provide any type of electrical connection between two electrical devices.

Figure 4:
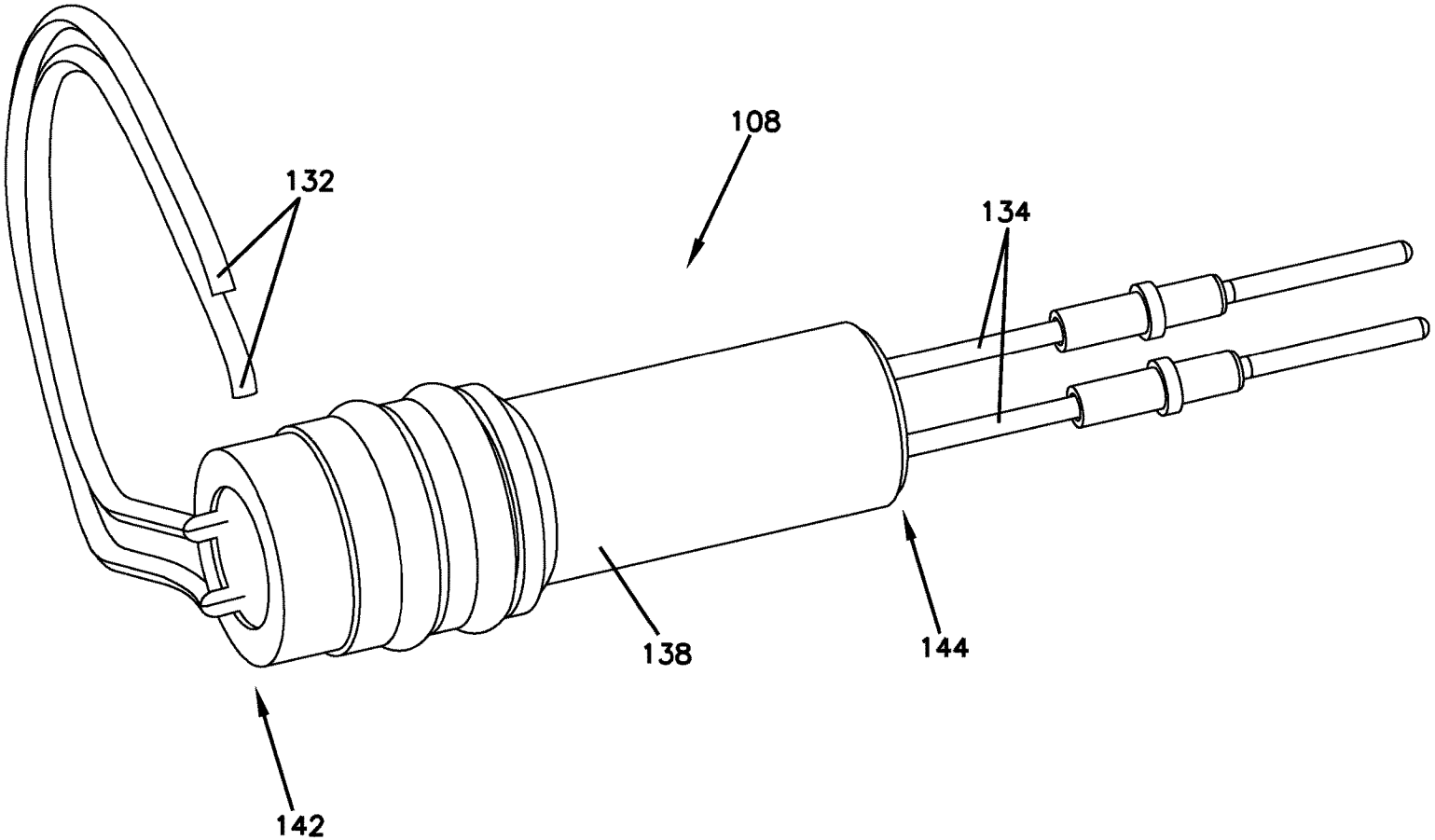
FIG. 4 is a perspective view of the electrical connector of FIG. 3.

FIG. 4 is a perspective view of the electrical connector 108 of FIG. 3. The electrical connector 108 includes a connector housing 138 with first and second ends 142 and 144 along a longitudinal axis. The first pair of wires 132 extends from the first end 142 of the connector 108, and the second pair of wires 134 extends from the second end 144 of the connector 108.

The electrical connector 108 further includes an outer sealing element 148 around the outer surface of the housing 138 of the connector 108. As shown in FIG. 2, the outer sealing element 148 is configured to seal the interface between the electrical connector 108 and the body 102. In some examples, the sealing element 148 includes one or more O-rings. In the depicted examples, the sealing element 148 includes two axially spaced-apart O-rings arranged around the outer surface of the connector housing 138. In other examples, the sealing element 148 includes other types of seals, such as back-up rings, lip seals, and any other suitable seals.

In some examples, the electrical connector 108 may be employed with the first and second ends 142 and 144 arranged at different pressures. For example, as shown in FIG. 2, the electrical connector 108 is mounted in the body 102 of the pilot valve system 100 such that the first end 142 of the connector 108 is exposed to the actuator chamber 126 and the second end 144 is exposed to the atmospheric surroundings. As described above, the pressure at the actuator chamber 126 can be higher than the atmospheric pressure.

Figure 5:
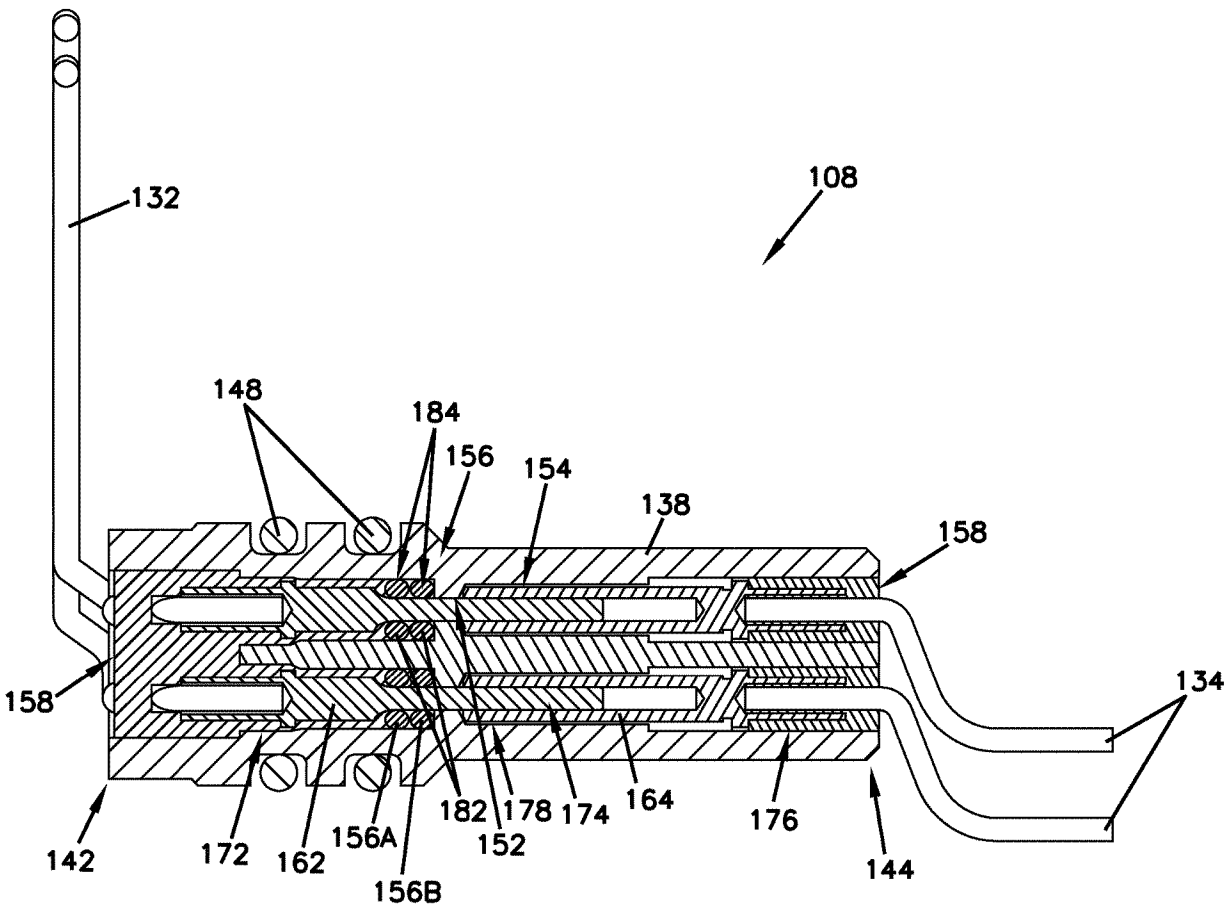
FIG. 5 is a cross-sectional view of the electrical connector of FIG. 3.

FIG. 5 is a cross-sectional view of the electrical connector 108 of FIG. 3. The electrical connector 108 includes a bore 152, a conductive pin assembly 154, an inner sealing element 156, and a sealant 158. In some examples, the pin assembly 154 includes a first sub-pin 162 and a second sub-pin 164. As shown in FIG. 5, the electrical connector 108 can have a pair of these components for the first and second pair of wires 132 and 134. In other examples, the electrical connector 108 can have more than two sets of these components for electrical connection between a plurality of wires. In yet other examples, the electrical connector 108 can have only one set of these components for electrical connection between two wires. For brevity purposes, only one set of the components are described below, and it is apparent that the same configurations and principles are applied to the other sets of the components.

The bore 152 is formed within the connector housing 138, extending between the first and second ends 142 and 144 and being open at the first and second ends 142 and 144. The bore 152 is configured to receive the conductive pin assembly 154 therein.

The conductive pin assembly 154 is arranged within the bore 152 and configured to engage the first set of wires 132 at the first end 142 and the second set of wires 134 at the second end 144. The first and second sets of wires 132 and 134 can be electrically connected to the conductive pin assembly 154 in any manner at the first and second ends 142 and 144. For examples, the first and second sets of wires 132 and 134 are crimped at the first and second ends 142 and 144 of the pin assembly 154. In other examples, the wires 132 and 134 can be welded at the ends 142 and 144 of the pin assembly 154.

In some examples, the conductive pin assembly 154 includes a first sub-pin 162 and the second sub-pin 164 electrically connected to the first sub-pin 162. In some examples, the first and second sub-pins 162 and 164 are made of a conductive material. The first sub-pin 162 is arranged within the bore 152 and has a first wire end 172 and a first coupling end 174. The first wire end 172 is configured to electrically engage the first wire 132, and the first coupling end 174 is configured to electrically engage the second sub-pin 164, as described below. The second sub-pin 164 is arranged within the bore 152 in series with the first sub-pin 162 along a longitudinal axis. The second sub-pin 164 has a second wire end 176 and a second coupling end 178. The second wire end 176 is configured to electrically engage the second wire 134. The second coupling end 178 is configured to electrically engage the first coupling end 174 of the first sub-pin 162. The first and second wire ends 172 and 178 can engage the first and second wires 132 and 134 in any manner suitable for electrically and mechanically connecting the wires 132 and 134. In some examples, the wires 132 and 134 can be crimped at the first and second wire ends 172 and 176. The first and second coupling ends 174 and 178 can be electrically engaged each other in any suitable manner. In some examples, the first coupling end 174 of the first sub-pin 162 is configured as a conductive rod, and the second coupling end 178 of the second sub-pin 164 is configured as a complementary conductive socket that receives the conductive rod and becomes in electrical contact with the conductive rod.

The inner sealing element 156 is arranged around the pin assembly 154 to provide seals at the interface between the bore 152 and the pin assembly 154. In some examples, the inner sealing element 156 can be one or more O-rings arranged around the outer surface of the pin assembly 154. In the depicted example, the inner sealing element 156 includes two O-rings. In some examples, the pin assembly 154 can provide one or more recesses 182 to place the inner sealing element 156 in place, and the bore 152 can provide one or more recesses 184 corresponding to the recesses 182 of the pin assembly 154 so that the inner sealing element 156 is interposed in place between the bore 152 and the pin assembly 154. In some embodiments, the inner sealing element 156 can include only one O-ring. Although the inner sealing element 156 is illustrated as O-rings in this example, other types of sealing elements are also possible, such as back-up rings, lip seals, and any other suitable seals.

In addition to the inner sealing element 156, the sealant 158 can be employed to the electrical connector 108 to provide additional seals and help retaining the wires 132 and 134 in place. The sealant 158 is viscous when applied and has little or no flow characteristics when cured. The sealant 158 can be of any type suitable for providing seals and restraining the movement of the wires 132 connected to the pin assembly 154. In some examples, the sealant 158 is an epoxy-based sealant.

In some examples, the sealant 158 is provided to fill the bore 152 after the pin assembly 154 and the inner sealing element 156 are inserted within the bore 152. For example, the sealant 158 can fill a space of the bore 152 formed between the first end 142 and the inner sealing element 156 along the longitudinal axis. In the examples where the inner sealing element 156 includes a plurality of O-rings 156A and 156B (i.e., a first seal 156A and a second seal 156B) arranged adjacent one another, the sealant 158 is filled to contact the O-ring 156A that is closer to the first end 142 than other O-rings 156B, and the sealant 158 is configured not to contact the other O-rings 156B. The first seal 156A (e.g., the O-ring 156A) operates to isolate the sealant 158 and the second seal 156B (e.g., the O-ring 156B). This configuration permits the other O-rings 156B that is arranged farther from the first end 142 to maintain their flexibility, thereby improving the sealing between the bore 152 and the pin assembly 154. In other embodiments, while the second seal 156B is an O-ring or any suitable seal, the first seal 156A can be any element (e.g., a back-up ring, a lip seal, or any suitable component) configured to isolate the sealant 158 from the second seal 156B.

In other examples, other types of seals can be used for the first and second seals 156A and 156B of the inner sealing element 156. For example, at least one of the first seal 156A and the second seal 156B can be a back-up ring, a lip seal, and any other seals suitable for the purpose of the first and second seals 156A and 156B.

The sealant 158 also operates as a wire restrainer so that the wires 132 connected to the pin assembly 154 at the first end 142 are fixed within the bore 152 and maintain their mechanical and electrical connectivity to the pin assembly 154.

Similarly, the sealant 158 can also be provided to fill the bore 152 at the second end 144. The sealant 158 provides environmental seals at the second end 144 and retains the wires 134 in place at the second end 144. In some examples, the sealant 158 can be provided to the bore 152 only either at the first end 142 or at the second end 144. In other examples, the sealant 158 can be provided to the bore 152 at both the first and second ends 142 and 144.

Figure 6:
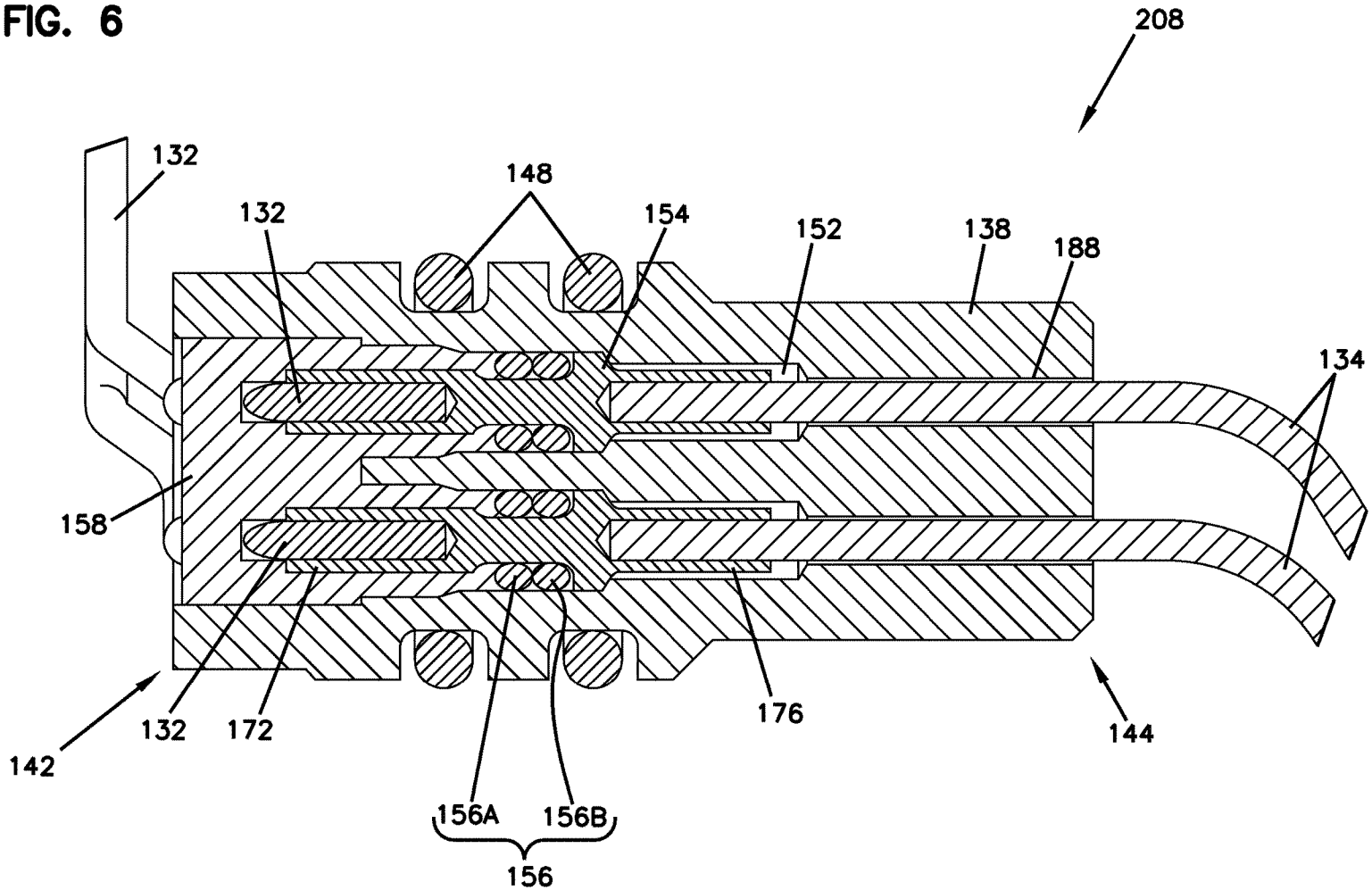
FIG. 6 is a cross-sectional view of an electrical connector according to another example of the present disclosure.

FIG. 6 is a cross-sectional view of an electrical connector 208 according to another example of the present disclosure. As many of the concepts and features are similar to the first example shown in FIGS. 3-5, the description for the first example is hereby incorporated by reference for the second example. Where like or similar features or elements are shown, the same reference numbers will be used where possible. The following description for the second example will be limited primarily to the differences between the first and second examples.

In this example, the pin assembly 154 of the electrical connector 208 is integrally formed as one conductive piece. The pin assembly 154 includes the first and second wire ends 172 and 176 configured to engage the wires 132 and 134, respectively. In some examples, as described above, the wires 132 and 134 can be crimped at the first and second wire ends 172 and 176, respectively, so that the wires 132 and 134 are electrically and mechanically coupled to the first and second wire ends 172 and 176. In this manner, the pin assembly 154 provides an electrical connection between the first wire 132 and the second wire 134. As such, the electrical connector 208 removes a coupling between two sub-pins within the bore 152, as shown in FIGS. 4 and 5, and thus can improve electrical and mechanical connectivity between the wires 132 and 134.

In some examples, the connector housing 138 includes a wire passage 188 adjacent the second end 144. The wire passage 188 is configured to provide a passage through which the wire 134 extends between the inside of the bore 152 and the outside of the housing 138. The wire passage 188 can provide a support for the wire 134 to retain the wire 134 in place. The wire passage 188 can replace the sealant 158 that would otherwise be used to secure the wire 134, as described with reference to FIG. 5. Although, in the depicted example, the wire passage 188 is formed adjacent the second end 144 and the sealant 158 is provided at the first end 142, the wire passage 188 can be provided adjacent the first end 142 and the sealant 158 can be provided at the second end 144 in other examples.

The various examples described above are provided by way of illustration only and should not be construed to limit the scope of the present disclosure. Those skilled in the art will readily recognize various modifications and changes that may be made without following the examples and applications illustrated and described herein, and without departing from the true spirit and scope of the present disclosure.

What is claimed is:

1. An electrical connector comprising:

a housing having a bore and first and second ends, the bore extending between the first and second ends;

a conductive pin arranged within the bore and configured to engage a first wire at the first end and a second wire at the second end;

a first seal arranged around the conductive pin and engaged between the conductive pin and the bore; a sealant filling the bore between the first end and the first seal such that the sealant contacts a portion of the first seal that faces the first end, and a second seal arranged around the conductive pin adjacent the first seal, wherein the first seal is positioned between the second seal and the sealant, and wherein the first seal isolates the second seal from the sealant such that the second seal does not contact and is not exposed to the sealant.

2. The connector according to claim 1, wherein, when the electrical connector is in use, the first end is arranged at a first pressure and the second end is arranged at a second pressure, the first pressure is greater than the second pressure.

3. The connector according to claim 1, wherein the sealant is an epoxy-based sealant.

4. The connector according to claim 1, further comprising an outer seal arranged around the housing and configured to provide seal between the housing and an apparatus to which the electrical connector is installed.

5. The connector according to claim 1, further comprising:

a second bore formed in the housing;

a second conductive pin arranged within the second bore;

a third seal arranged around the second conductive pin and engaged between the second conductive pin and the second bore to provide seal therebetween; and a second sealant filling the second bore between the first end and the third seal.

6. The connector according to claim 5, further comprising a fourth seal arranged around the second conductive pin adjacent the third seal, wherein the fourth seal is positioned between the third seal and the second sealant, and wherein the fourth seal is not exposed to the second sealant.

7. The connector according to claim 5, wherein the second conductive pin comprises:

a third sub-pin arranged within the second bore and having a third wire end and a third coupling end; and a fourth sub-pin arranged within the second bore and having a fourth wire end and a fourth coupling end, the fourth coupling end engaging the third coupling end of the third sub-pin.

8. The connector according to claim 5, wherein the second sealant is an epoxy-based sealant.

9. The connector according to claim 1, wherein the flexible second seal includes an O-ring.

10. The connector according to claim 1, wherein the conductive pin includes:

a first conductive sub-pin having a first wire end and a first coupling end, the first wire end electrically engaging the first wire at the first end; and a second conductive sub-pin having a second wire end and a second coupling end, the second wire end electrically engaging the second wire at the second end, and the second coupling end configured to be complementary to the first coupling end and coupled to the first coupling end of the first sub-pin.

11. The connector according to claim 10, wherein the first coupling end of the first conductive sub-pin is configured as a conductive rod, and the second coupling end of the second conductive sub-pin is configured as a conductive socket complementary to the conductive rod.

12. The electrical connector of claim 1, wherein the first seal provides a seal between the conductive pin and the bore, and wherein the first seal comprises one of an O-ring, a back-up ring, and a lip seal.

13. A system comprising:

a system housing;

a first electrical device arranged at a first pressure;

a second electrical device arranged at a second pressure; and an electrical connector engaged within the system housing and configured to electrically connect the first electrical device to the second electrical device, the connector comprising:

a connector housing having a bore and first and second ends, the first end arranged at the first pressure, the second end arranged at the second pressure, and the bore extending between the first and second ends;

an outer seal arranged around the connector housing and configured to provide seal between the connector housing and the system housing;

a first wire electrically connected to the first electrical device;

a second wire electrically connected to the second electrical device;

a conductive pin arranged within the bore and configured to engage the first wire at the first end and the second wire at the second end;

a first seal arranged around the conductive pin and engaged between the conductive pin and the bore; a sealant filling the bore between the first end and the first seal such that the sealant contacts a portion of the first seal that faces the first end, and a second seal arranged around the conductive pin adjacent the first seal, the first seal positioned between the second seal and the sealant such that the first seal isolates the second seal from the sealant such that the second seal does not contact and is not exposed to the sealant.

14. The system according to claim 13, wherein the first pressure is greater than the second pressure.

15. The system according to claim 13, wherein the sealant is an epoxy-based sealant.

16. The system according to claim 13, wherein the conductive pin includes:

a first conductive sub-pin having a first wire end and a first coupling end, the first wire end electrically engaging the first wire at the first end; and a second conductive sub-pin having a second wire end and a second coupling end, the second wire end electrically engaging the second wire at the second end, and the second coupling end configured to be complementary to the first coupling end and coupled to the first coupling end of the first sub-pin.

17. The system according to claim 16, wherein the first coupling end of the first conductive sub-pin is configured as a conductive rod, and the second coupling end of the second conductive sub-pin is configured as a conductive socket complementary to the conductive rod.

18. The system of claim 13, wherein the first seal provides a seal between the conductive pin and the bore, and wherein the first seal comprises one of an O-ring, a back-up ring, and a lip seal.

19. A pilot valve system comprising:

a body having a fluid inlet and a fluid outlet;

a solenoid assembly operated at a first pressure;

a control unit operated at a second pressure lower than the first pressure;

a spool assembly engaged with the solenoid assembly and operated to control fluid flow between the fluid inlet and the fluid outlet;

an electrical connector engaged within the body and configured to electrically connect the control unit to the solenoid assembly, the connector comprising:

a connector housing having a bore and first and second ends, the first end arranged at the first pressure, the second end arranged at the second pressure, and the bore extending between the first and second ends;

an outer seal arranged around the connector housing and configured to provide seal between the connector housing and the system housing;

a first wire electrically connected to the solenoid assembly;

a second wire electrically connected to the control unit;

a conductive pin arranged within the bore and configured to engage the first wire at the first end and the second wire at the second end;

a first seal arranged around the conductive pin and engaged between the conductive pin and the bore; a sealant filling the bore between the first end and the first seal such that the sealant contacts a portion of the first seal that faces the first end, and a second seal arranged around the conductive pin adjacent the first seal, the first seal positioned between the second seal and the sealant such that the first seal isolates the second seal from the sealant such that the second seal does not contact and is not exposed to the sealant.

20. The system according to claim 19, wherein the sealant is an epoxy-based sealant.

21. The system according to claim 19, wherein the conductive pin includes:

a first conductive sub-pin having a first wire end and a first coupling end, the first wire end electrically engaging the first wire at the first end; and a second conductive sub-pin having a second wire end and a second coupling end, the second wire end electrically engaging the second wire at the second end, and the second coupling end configured to be complementary to the first coupling end and coupled to the first coupling end of the first sub-pin.

22. The system according to claim 21, wherein the first coupling end of the first conductive sub-pin is configured as a conductive rod, and the second coupling end of the second conductive sub-pin is configured as a conductive socket complementary to the conductive rod.

23. The pilot valve system of claim 19, wherein the first seal provides a seal between the conductive pin and the bore, and wherein the first seal comprises one of an O-ring, a back-up ring, and a lip seal.

* * * * *